US005171423A

United States Patent [19]

Kruse

[11] Patent Number: 5,171,423

[45] Date of Patent: Dec. 15, 1992

[54] FCU CATALYST SEPARATION AND STRIPPING PROCESS

[75] Inventor: Larry W. Kruse, Crete, Ill.

[73] Assignee: Amoco Corporation, Chicago, Ill.

[21] Appl. No.: 529,204

[22] Filed: May 25, 1990

[51] Int. Cl.[5] ..... C10G 11/00

[52] U.S. Cl. ..... 208/113; 208/48 Q; 208/161

[58] Field of Search ..... 208/48 Q, 113, 161

[56] References Cited

U.S. PATENT DOCUMENTS

| | | | |
|---|---|---|---|
| 2,881,129 | 4/1959 | Andrews et al. | 208/157 |
| 3,261,776 | 7/1966 | Baumann et al. | 208/113 |
| 4,049,540 | 9/1977 | Ueda et al. | 208/48 Q |
| 4,256,567 | 3/1981 | Bartholic | 208/252 |
| 4,624,772 | 11/1986 | Krambeck et al. | 208/161 |
| 4,764,268 | 8/1988 | Lane | 208/48 Q |
| 4,853,107 | 8/1989 | Haddad et al. | 208/161 |
| 4,917,790 | 4/1990 | Owen | 208/113 |

*Primary Examiner*—Curtis R. Davis
*Assistant Examiner*—William C. Diemler
*Attorney, Agent, or Firm*—Thomas W. Tolpin; William H. Magidson; Ralph C. Medhurst

[57] ABSTRACT

A catalytic cracking process is provided for cost effectively separating and stripping hydrocarbon from catalyst while limiting the occurrence of undesired catalytic overcracking and thermal cracking reactions. The process includes the steps of contacting feed with catalyst, grossly separating the larger coked catalyst particles from the hydrocarbon, disengaging the smaller coked catalyst fines from the hydrocarbon, removing volatile hydrocarbon from the grossly separated and disengaged catalyst, and recycling the volatile hydrocarbon back to the gross separating step. The disengager step includes the steps of dampening the flow of grossly separated hydrocarbon and internally cyclone separating the smaller catalyst fines from the hydrocarbon product.

17 Claims, 1 Drawing Sheet 4
5
6
7
8
9
10
11
12
13
14
16
17
18
19
19A
19B
20
21
22
23
24
25
26
27
28
29
30
31
32
33
34
35
36
37
38
39
40
41
42
3
3A
1
1A
15

FCU CATALYST SEPARATION AND STRIPPING PROCESS

BACKGROUND OF THE INVENTION

1. Field of Invention

This invention relates to a process for the separation of catalyst from hydrocarbon in a fluid catalytic cracking unit (FCU).

2. Background

Gasoline and distillate liquid hydrocarbon fuels are the primary finished products for most petroleum refiners. These fuels boil in the range of about 100° F. to about 650° F. However, the crude oil from which these fuels are derived can often contain from 30 to 70 percent by volume hydrocarbon boiling above 650° F. The process of fluid catalytic cracking breaks apart high boiling point, high molecular weight molecules into lower boiling point, lower molecular weight products that can be blended into gasoline and distillate fuels.

Fluid catalytic cracking units operate through the introduction of a hot fluidized catalytic cracking catalyst into a high molecular weight feed at the upstream end of a riser reactor. Once contacted with the hot catalyst, the feed is vaporized, carrying a suspension of catalyst and hydrocarbon up through the riser reactor. The hot catalyst supplies all or a major portion of the heat necessary to vaporize the hydrocarbon feed and carry out the endothermic catalytic cracking reaction.

The suspension of catalyst and hydrocarbon vapor passes up the riser reactor at high velocity. However, due to the high activity of the catalyst, the cracking reaction generally proceeds to the desired extent prior to or upon reaching the upper or downstream end of the riser reactor. The cracked hydrocarbon must then be separated from the catalyst and further processed into upgraded products. The catalyst, which has accumulated coke in the cracking reaction, must be stripped to remove extraneous hydrocarbons and regenerated prior to reintroduction into the riser reactor. Process improvements in this separation and stripping step is the subject of this invention.

Many catalytic cracking advancements have been made in the area of catalyst separation, catalyst stripping, and prevention of undesired catalytic reactions. Some catalytic cracking equipment had bed crackers with sloped risers. The sloped riser performed the function of carrying the oil and catalyst to the catalyst bed where most of the reaction occurred. Slower catalytic reaction times facilitated the operation of bed crackers and were a result of the lower activity catalyst prevalent at the time and lower reaction temperatures. Catalyst separation from hydrocarbon was performed in cyclones erected in the reaction vessel. Quick disengaging of catalyst from hydrocarbon was not as necessary to prevent undesired overcracking reactions due to the lower catalyst activity and reaction temperatures. Catalyst stripping was performed in a stripper section communicating with the catalyst bed.

As crude costs increased, gasoline volume and octane requirements remained strong, and the phase out of lead from gasoline took effect, refiners stepped up cracking catalyst development efforts. High activity catalysts, particularly crystalline zeolite cracking catalysts, were developed, followed by processing techniques and equipment permitting higher reactor temperatures. However, as reaction temperatures and catalyst to oil ratio were increased, it was observed that much of the desired catalytic reaction was occurring in the riser. Refiners began developing processes designed to perform the cracking reactions in the riser. The fundamental process change required longer, more vertically positioned riser reactors, which resulted in more effective catalyst to oil mixing. The vertical riser facilities reduced undesirable light gas production, increased feed conversion to light products, increased gasoline octane, and lowered undesirable coke production.

An unexpected penalty associated with higher catalyst activity and higher reactor temperatures was the occurrence of catalytic overcracking and thermal cracking. Unless the catalyst was quickly removed from the hydrocarbon, undesirable overcracking reactions would occur, reducing gasoline yield and increasing light gas production. Older prior art catalytic cracking units were not equipped to mitigate this condition. Newer facilities began to recognize the problems associated with overcracking and thermal cracking and included roughcut cyclone separation erected in close proximity to or communicating with the riser reactor to help reduce the problem.

In some types of catalytic cracking units, the riser penetrates the center of the disengager vessel. These units afford quick separation of catalyst from oil by positioning an inverted can over the riser outlet. The catalyst and hydrocarbon is directed downwards where the catalyst is directed towards a stripping section positioned immediately below the disengaging section of the disengager vessel or to a separate stripper vessel. The hydrocarbon pressures back through the inverted can and is further separated from catalyst in secondary cyclones prior to exiting the disengager. The extended hydrocarbon flow pattern between the inverted can and the secondary cyclones permits undesirable thermal cracking reactions to occur at high reaction temperatures and detracts from the utility of center riser designs.

The center riser facility also can have a completely enclosed internal "hot-wall" roughcut separator and secondary cyclones. Enclosed "hot-wall" roughcut separator designs translate into more costly and time-consuming maintenance. Prior art internal "hot-wall" vessels require more expensive metallurgy, thicker steel, exotic refractory and erosion protection, as well as more costly rigging to assemble the cyclone within another vessel than the external cyclone alternative. Moreover, internal cyclone failures in hot-wall vessels are difficult to visually detect. Repairs are also more difficult to perform, usually requiring unit shutdown as well as long, time-consuming preparation steps prior to and upon entry into the disengager vessel.

Some prior art catalytic cracking units have an external positioned vertical riser with a closely connected external roughcut separator. Such units provide quick separation of catalyst from oil by the close proximity of the roughcut separator to the riser outlet. However, the process is more expensive to build due to additional ductwork and plot space requirement.

Other prior art catalytic cracking units have been employed to address many of the objectives and problems noted above, each with varying degrees of success and limitations.

Anderson et al., U.S. Pat. No. 4,043,899, describes internal cyclones which have been modified to include cyclonic stripping of catalyst separated from hydrocarbon vapors from a center riser catalytic cracking unit.

Parker et al., U.S. Pat. No. 4,455,220, describes a single vessel cyclone separator and stripper process having a vortex stabilizer mechanism separating the two vessel sections. The Parker design also has a secondary cyclone connected directly to the single vessel roughcut cyclone outlet without benefit of a disengaging space. While the design features less equipment and can be built for a lower cost, the generically nonuniform flow of riser reactors can pose difficulties for these systems. When the riser outlet flow surges upwards, roughcut separation efficiency is greatly reduced and excessive amounts of hydrocarbon can drop down to the stripper section while excessive amounts of catalyst spew out the top of the cyclone. This continuous cycling results in undesired overcracking in the roughcut cyclone hydrocarbon outlet and the potential for catalyst defeating the secondary cyclone and breaking through to downstream equipment.

SUMMARY OF THE INVENTION

It is an objective of this invention to provide an improved process for reliably separating catalyst from hydrocarbon that: enhances the maintenance and reliability advantages of external separation; reduces thermal cracking, compensates for the nonuniformity in flow from riser-reactors and the adverse effects of flow swings on cyclone performance; and achieves these results at minimum cost and complexity.

It is an additional object of this invention to provide an improved process for thoroughly and reliably stripping volatile hydrocarbon from coked catalyst, that provides adequate disengaging space and stripping gas access, while not requiring excessive facilities.

The present process achieves the above objectives by: contacting a hydrocarbon feed with fluidized catalytic cracking catalyst and producing a suspension of hydrocarbon product and coked catalyst, where the coked catalyst comprises larger coked catalyst particles and smaller coked catalyst fines; grossly separating the coked catalyst particles from the suspension in a grosscut cyclone and producing a grossly separated first stream of hydrocarbon product and coked catalyst fines and a grossly separated second stream of coked catalyst particles; substantially disengaging the coked catalyst fines from the grossly separated first stream and producing a substantially catalyst free stream of hydrocarbon product and a stream of disengaged coked catalyst fines; substantially removing volatile hydrocarbon from the coked catalyst and producing a volatile hydrocarbon product and a stripped coked catalyst by gas stripping the grossly separated second stream of coked catalyst particles and the stream of disengaged coked catalyst fines; and recycling at least a portion of the volatile hydrocarbon product to the grosscut cyclone for gross separation along with the suspension of hydrocarbon product and coked catalyst for producing the grossly separated first stream of hydrocarbon product and coked catalyst fines and the grossly separated second stream of coked catalyst particles.

Desirably, the disengaging step includes dampening the flow of the grossly separated first stream of hydrocarbon product into a substantially steady flow of grossly separated hydrocarbon product. The disengaging step further includes internally cyclone separating the steady flow and producing a substantially catalyst free stream of hydrocarbon product and a stream of disengaged coked catalyst fines.

In the preferred embodiment of the present invention, a hydrocarbon quench stream is injected into the grossly separated first stream of hydrocarbon product for substantially reducing undesired thermal cracking reactions. The preferred hydrocarbon quench stream is light cat cycle oil and/or heavy cat cycle oil.

In the preferred form, the substantially removing and recycling steps include removing volatile hydrocarbon from the coked catalyst by directing the coked catalyst downward, along a convoluted flowpath, and annularly about and countercurrently in direction to the volatile hydrocarbon product. The steps further include directing the volatile hydrocarbon product upwardly in countercurrent flow relationship to the coked catalyst, so that the flow of hydrocarbon product is concentric, and annularly surrounded by the flow of coked catalyst. The volatile hydrocarbon product is subsequently recycled to the gross separation step.

A more detailed description of the invention is provided in the following specification and claims taken in conjunction with the accompanying drawing.

BRIEF DESCRIPTION OF THE DRAWING

The FIGURE is a schematic flow diagram of a catalytic cracking process in accordance with principles of the present invention.

DETAILED DESCRIPTION OF THE PREFERRED EMBODIMENTS

Figure 1:
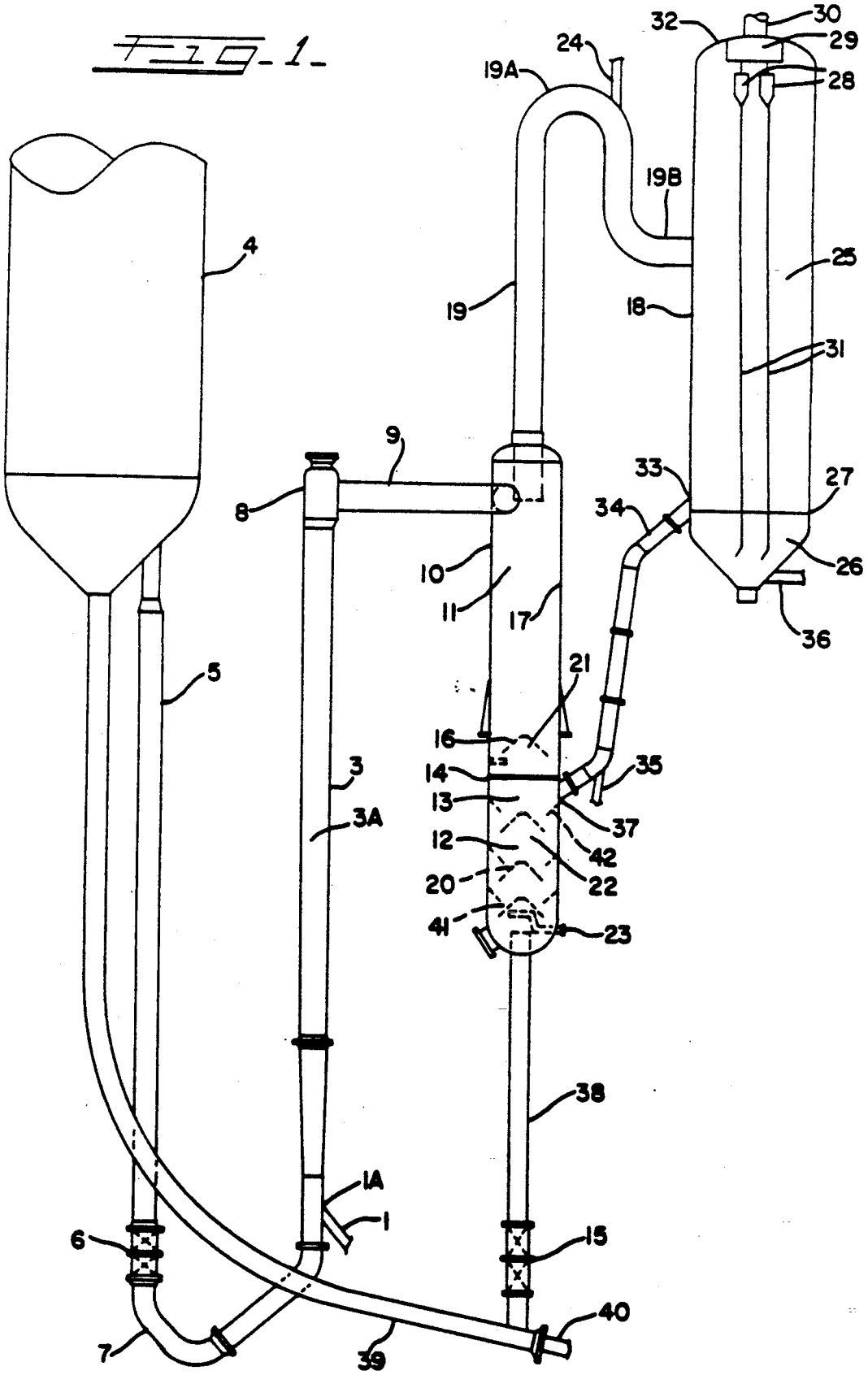

The present invention provides an improved catalytic cracking unit apparatus and process for cost-effectively and reliably separating and stripping hydrocarbon from catalyst to achieve a substantially catalyst-free hydrocarbon product while limiting the occurrence of undesired catalytic overcracking and thermal cracking reactions.

The process of catalytic cracking and the present invention in particular begins with a high boiling catalytic cracker feedstock which generally comprises a mixture of distillate range material boiling between 430° F. and 650° F., gas oil range material boiling between 650° F. and 1000° F., and resid range material boiling at greater than 1000° F. The feedstock, also referred to as hydrocarbon feed, high molecular weight feed, and gas oil feed is generally dominated by the gas oil fraction. The hydrocarbon feed line 1 of the FIGURE connects at point 1A to vertical upright riser reactor 3. The riser reactor comprises a substantially vertical tubular riser reaction zone 3A. The hot regenerated fluidized catalytic cracking catalyst is supplied to the vertical riser reactor 3 from the regenerator 4. Hot catalyst flows from the regenerator 4, through a catalyst feedline or standpipe 5, through two standpipe catalyst slide valves 6, and curved J-Bend 7, prior to entry into the vertical riser reactor 3. The catalyst is generally supplied at temperatures ranging from 1000° F. to 1500° F.

Suitable hydrocarbon cracking catalysts for use in the practice of this invention include those of the amorphous silica-alumina type having an alumina content of about 10 to about 50 weight percent. Catalysts of the silica-magnesia type are also suitable which have a magnesia content of about 20 weight percent. Preferred catalysts include those of the zeolite-type which comprise from about 0.5 to about 50 weight percent and preferably from about 1 to about 30 weight percent of a crystalline aluminosilicate component distributed throughout an amorphous matrix. Zeolite-type cracking catalysts are preferred because of their thermal stability, high catalytic activity and selectivity.

Catalyst addition to the vertical riser reactor is controlled by the two catalyst slide valves 6. If desired, one catalyst slide valve can be used. Catalyst addition through the standpipe slide valve 6 is generally controlled to target a combined catalyst and oil vertical riser reactor outlet 8 temperature. To reach higher reactor temperatures, the ratio of catalyst to oil is generally higher, hydrocarbon conversion is increased, and the potential for undesirable catalytic overcracking and thermal cracking reactions is increased. At lower vertical riser reactor temperature targets, the standpipe slide valves 6 constrict, reducing the catalyst to oil ratio, lowering hydrocarbon conversion, and reducing the potential for undesirable catalytic overcracking and thermal cracking reactions. Conversion for the purpose of this patent application is defined as the percentage, by weight, of feed boiling over 430° F. converted to products below 430° F. and coke.

The vertical riser reactor 3 is where most of the catalytic cracking reaction substantially takes place. Hydrocarbon feed is substantially vaporized upon contact with the hot catalyst and the catalyst and vapor suspension catalytically react as the hydrocarbon stream proceeds up the vertical riser reactor 3 to produce an upgraded catalyst-laden product stream of catalytically cracked hydrocarbon (oil vapors) and coked spent cracking catalyst comprising larger coked cracking catalyst particulates and smaller coked cracking catalyst fines. The catalyst accumulates coke in the process of converting the hydrocarbon to lighter products.

Not all industry fluid catalytic crackers feature vertical riser designs. Some refiners are still using sloped riser bed crackers. Vertical risers are generally preferred by most refiners since vertical risers improve catalyst and hydrocarbon mixing, reduce coke production, and reduce the period of hydrocarbon vaporization increasing reaction time available in the riser for the desired cracking reactions. Vertical risers also result in lower riser wall temperatures which reduces undesired light hydrocarbon gas production and prolongs riser life.

Upon reaching the top 8 of the vertical riser reactor 3, the coked catalyst and vapor suspension passes through a horizontal linkage line 9 to external means comprising an external elongated, upright combined unitary stripper and cyclone vessel 10. The horizontal linkage line 9 length is minimized to reduce the coked catalyst in oil resonance time to substantially eliminate undesired catalytic overcracking and thermal cracking reactions.

The external elongated upright combined unitary vessel 10 includes an upper external roughcut or grosscut separation section 11 providing a roughcut gross separation means with a roughcut gross cyclone, also referred to as a grosscut cyclone, in the upper portion of the vessel 10 and a lower coked catalyst stripping section 12 providing stripping means with a stripper in the lower portion of the vessel 10. The roughcut gross cyclone grossly separates the coked catalyst particulates from the catalyst-laden product stream, as well as from recycled volatile hydrocarbon products as explained below, to produce a grossly separated particulate lean stream of hydrocarbon and grossly enriched stream of coked catalyst particulates. The horizontal linkage line 9 communicates with the roughcut cyclone section 11 tangentially to create swirling action necessary for particulate separation. The stripper removes and strips volatile hydrocarbon from the grossly separated particulate enriched stream of coked catalyst particulates as well as from the disengaged coked catalyst fines, as explained below, by directing the coked catalyst along a convoluted path in the presence of stripping stream, leaving volatile hydrocarbon products and stripped coked catalyst.

Since the external roughcut cyclone section 11 is combined with stripper section 12, it is important that the vortex action of the cyclone does not conflict with the operation of the stripper section. Should the tail of the vortex extend to the coked catalyst dense bed phase 13, coked catalyst could be fluidized back into the external roughcut cyclone section, reducing cyclone efficiency. Extension of the vortex tail could also disrupt the dense bed coked catalyst level 14. This level must remain steady since it is often utilized to control at least one of the two stripper slide valve positions 15.

The unitary vessel 10 provides a dual function external means which is designed to accommodate both separation and stripping functions by proper dimensioning of the vessel itself, the cyclone separator design, and the horizontal linkage line. It is important to provide sufficient distance between the tail of the vortex and the stripper section dense bed level 14 in order to maintain cyclone performance and hold a steady dense bed coked catalyst level 14. The following formula provides the calculation for vortex length and the design parameters available to ensure sufficient space between the vortex tail and the coked catalyst dense bed level.

$$\text{Vortex Length} = 2.3\ DE(DC^2/(AB))^{\frac{1}{3}}$$

Where:

DE is the cyclone hydrocarbon outlet diameter

DC is the cyclone diameter

A is the cyclone inlet duct width

B is the cyclone inlet duct height

An annular frusto conical deflector 16 is provided as an additional barrier between the vortex tail and the coked catalyst dense bed level 14. The annular deflector 16 comprises a tubular frusto conical baffle with an upwardly slanted converging sidewall designed to channel volatile hydrocarbon upwardly through a central opening (hole) from the stripping section 12 and recycle the hydrocarbon back through the center of the cyclone 11. Channeling hydrocarbon concentrically through the cyclone center minimizes disturbance to coked catalyst flowing downward the cyclone inner wall 17. The downwardly diverging flared sidewalls of the annular deflector 16 provide a skirt which is spaced from and cooperates with the cyclone innerwall 17 to form an annular catalyst passageway therebetween for annularly passing and dispersing the catalyst downwardly and outwardly at an angle of inclination ranging from 15 degrees to 75 degrees relative to the vertical axis of the vessel 10 and in a diverging manner into the baffled stripper section 12. The stripped volatile hydrocarbon product is channeled and passed upwardly through the central opening of the deflector 16 in countercurrent flow relationship to the downwardly passing grossly separated annular particulate-enriched stream of coked catalyst particulates, so as to pass and be recycled to the grosscut cyclone in the upper separation section 11 of the vessel 10. The upward stream of hydrocarbon product flows generally along and about the vertical axis of the vessel 10 and 15 substantially concentric to and annularly surrounded by the downward flow of the grossly separated particulate-enriched stream of coked catalyst particulates along and outwardly of the skirt of the deflector 16.

Some prior art catalytic cracking units have gross cyclone separation sections which are designed to be internal to the disengager vessel. Internal gross cyclone separation sections can be used for quick separation of coked catalyst from the oil upon exiting the riser outlet. The present invention provides for quick coked catalyst separation while not incurring the penalties of an internal separator design.

Internal separator designs translate into more costly and time-consuming maintenance. Internal "hot-wall" vessels require more expensive metallurgy, thicker steel, exotic refractory and erosion protection, as well as more costly rigging to assemble the cyclone within another vessel than the external cyclone alternative. Moreover, internal cyclone failures in hot-wall vessels are difficult to visually detect. Repairs in hot-wall vessels are also more difficult to perform, usually requiring unit shutdown as well as long, time-consuming preparation steps prior to and upon entry into the disengager vessel.

The stripper section 12 is also contained in the combined unitary vessel 10 comprising the external means. The stripper section 12 is positioned at the bottom portion of the vessel 10 below the upper external roughcut cyclone separation section 11. In the preferred embodiment, the stripper section 12 has an array of internals comprising alternating tiers of conical baffles 20 with the peaks of the conical baffles facing upwards. The baffle design causes the coked catalyst to follow a convoluted flow path increasing contact and countercurrent exposure between the stripping gas and the coked catalyst, effecting a more thorough removal of volatile hydrocarbon product from coked catalyst. The stripping section has an upper dilute phase stripping area 21 located between the annular deflector 16 and the dense bed coked catalyst level 14 and a lower dense bed stripping area 22 located below the dense bed coked catalyst level 14. Stripping gas can be injected by one or more stripping gas injectors 23 at any level within the lower dense bed stripping area 22, although the preferred embodiment features a stripper gas injector 23 located below the bottom conical baffle 41. The preferred stripping gas is steam for best results.

The upper external roughcut cyclone separator hydrocarbon product outlet 19, also referred to as cyclone product outlet and tubular crossover, extends upwardly from the vessel 10, looping back down via an inverted semicircular U-shaped section 19A to a substantially horizontal tubular duct section 19B prior to entering an upright vertical disengager vessel 18. The inverted semicircular U-shaped loop 19A is provided as a means of accommodating expansion at temperatures that often exceed 1000° F.

Connected to the cyclone product outlet 19 is the quench injector 24 which is provided to inject a cycle oil quench, such as light catalytic cycle oil (LCCO) or heavy catalytic cycle oil (HCCO), into the product stream after gross separation of coked catalyst therefrom so as to reduce the occurrence of thermal cracking reactions in the hydrocarbon product. This is achieved by positioning the quench injection line (injector) 24 at a location on the downward bend of the downstream leg of the inverted U-shaped loop 19A to permit operation at high riser temperatures and higher resultant catalyst to oil ratios while concurrently quenching the cyclone product outlet stream immediately after rough catalyst removal and before substantial undesired thermal cracking reactions can occur.

Hydrocarbon quench is most effective when injected immediately after roughcut catalyst separation since less reaction time is provided for the undesired thermal cracking reactions to occur. In addition, less quench volume is required to perform an equivalent magnitude of quenching when the hot catalyst has been removed first. Excessive quench volume, beyond that necessary to substantially eliminate undesired thermal cracking reactions is energy inefficient and can limit downstream fractionator capacity. A direct enclosed hydrocarbon conduit, such as the external roughcut cyclone outlet 19 in the present invention, is the preferred structure for quench injection since this injection point is external, accessible, and substantially contains the entire hydrocarbon product stream immediately after roughcut separation. The preferred conduit 19 can also be cost-effectively retrofitted with quench injectors on stream or on unit shutdown.

The quench itself can include light catalytic cycle oil (LCCO), heavy catalytic cycle oil (HCCO), heavy catalytic naphtha, light coker gas oil, coker still distillates, kerosene, hydrotreated distillate, virgin gas oil, heavy virgin gas oil, decanted oil, resid, and water. The quench stream is preferably HCCO and most preferably LCCO for best results.

The upper external roughcut cyclone separator 11 is designed to accommodate a high coked catalyst loading. While the external roughcut cyclone separator 11 substantially removes about 96 to 98 percent of the larger coked catalyst particles, at a size of generally greater than 50 microns, it is not as efficient separating the smaller coked catalyst particles, at a size generally ranging from 20–50 microns, also known as coked catalyst fines from the cyclone product outlet.

Loss of roughcut cyclone efficiency can also be caused by the generally unsteady, pulsating flow of the riser reactor 3. When the riser reactor 3 intermittently produces surges of hydrocarbon and catalyst, the temporarily higher catalyst loading can result in the breakthrough of coked catalyst particles and more so of smaller catalyst fines into the cyclone product outlet 19 and into the disengaging vessel 18.

The disengager vessel 18 is spaced laterally and apart from the riser 3 and the external unitary vessel 10 and designed to substantially remove the remaining coked catalyst fines from the cyclone outlet product. The disengager vessel 18 itself performs the function of dampening and absorbing the intermittent surges in flow initiated in the riser 3 so as to dampen the flow of the cooler quenched steam of hydrocarbon, creating a steadier flow of hydrocarbon and coked catalyst fines.

The disengager vessel 18 has an upper dilute phase portion, area, or zone 25 and a lower dense phase portion, area, or zone 26 which are separated by the interface of the dense phase zone 27, also known as the disengager catalyst bed level. Inside the disengager vessel 18 are positioned at least one, and in the preferred embodiment, at least two internal cyclone separators 28, also known as internal secondary cyclones to separate the coked cracking catalyst fines from the steadier flow of cooled quenched hydrocarbon to produce an effluent product catalyst lean stream of upgraded hydrocarbon and a concentrated stream of disengaged coked catalyst fines. The secondary cyclones 28 can be in series or in parallel as pictured in the FIGURE. A parallel secondary cyclone configuration comprises splitting the steady flow of cooler quenched hydrocarbon into at least two streams, independently cyclone-separating at least two of the streams, and recombining the streams to produce the effluent product catalyst lean stream of upgraded hydrocarbon. The secondary cyclones are positioned in the upper dilute phase 25 where the hydrocarbon outlets of the secondary cyclones are connected to a plenum 29, which is secured to the roof 32 or top of the disengager vessel 18. The plenum 29 is connected to the outlet or disengaged product exit of the disengager 30, discharging the effluent product, comprising a catalyst fine-lean stream or substantially catalyst-free upgraded product stream of hydrocarbon, out of the disengager vessel for further processing. The bottom of the secondary cyclones 28 are connected to catalyst diplegs 31, which transport separated catalyst fines into the lower dense phase zone 26.

The disengager vessel 18 also includes disengaged catalyst outlet 33 to discharge a concentrated stream of disengaged coked catalyst fines to a catalyst conduit 34 comprising a catalyst recycle line for conveying and passing the catalyst fines to the external means stripping section dense bed phase 13 in the bottom portion of the vessel. In the preferred embodiment, the disengaged catalyst outlet 33 operates as a catalyst overflow line such that the level of the interface of the dense phase zone 27 is determined by the elevation of the catalyst outlet 33 adjusted for hydraulic considerations between the stripper section 13 of the external means and the disengager catalyst outlet 33. The level of the interface of the dense phase zone can also be controlled by a control valve on the catalyst conduit 34 along with the appropriate level control instrumentation.

It is the preferred embodiment of this invention to provide a first supplemental stripping steam injector 35 on the catalyst recycle line 34. It is also a preferred embodiment to provide a second supplemental steam injector 36 into the disengager lower dense phase zone 27. The supplemental stripping steam injectors can be used to reduce hydrocarbon carryover to the regenerator 4 as well as for catalyst fluidization. The total stripping steam provided through injector 23 and supplemental injectors 35 and 36 will generally be in a range of 1 to 15 pounds of steam per ton of catalyst circulated. Additional steam injection would be inefficient; reduced steam usage may result in excessive hydrocarbon breakthrough to the regenerator 4.

The entry position of the catalyst conduit 34 on the stripper section 12 in the preferred embodiment 37 is in the stripper section dense bed phase 13 above the topmost baffle 42. The entry position should be kept below the dense bed coked catalyst level 14. Entry above the dense bed coked catalyst level 14 could create catalyst level disturbances that can disrupt rough cut separator efficiency and stripper slide valve 15 operation. Entry above the top most baffle 42 can beneficially subject the catalyst fines to additional stripping gas exposure which can reduce hydrocarbon carryover to the regenerator 4. In some circumstances, it may be desirable to adjust the entry position to a lower location on the stripper section 12 or into the stripper outlet line 38.

An advantage of the disengager 18 and secondary cyclone 28 tandem is that the tandem ensures effective particulate removal from hydrocarbon product under extraordinary stripping conditions. Should a special need exist to substantially increase catalyst stripping, such as a regenerator temperature excursion, stripping steam may be increased to the first 35 and second 36 supplemental stripping steam injectors with substantially no detrimental effect. Additional stripping steam may be added to a third location in the combined unitary vessel stripping section, if desired, since the disengager and secondary cyclone tandem can recover catalyst that is not recovered in the roughcut cyclone.

The stripper outlet line 38 conveys stripped coked catalyst through the two stripper slide valves 15 for return to the regenerator vessel 4. The preferred embodiment includes two slide valves 15, although in some circumstances only one slide valve need be used. The stripper slide valves 15 are often controlled to maintain the dense bed coked catalyst level 14. The coked catalyst is dropped into the catalyst return line 39 for conveying back to the regenerator vessel 4. The coked catalyst is carried back to the regenerator 4 with a carrier gas injected through carrier line 40. The carrier stream in the preferred embodiment is compressed air but other gases may be utilized including steam.

The coked catalyst is conveyed back to the regenerator vessel 4 where the catalyst is contacted with an oxygen-containing gas stream, preferably air, containing an amount of molecular oxygen in excess of that necessary for substantially complete combustion of the coke accumulated on the catalyst in the cracking reaction and for substantially complete combustion of carbon monoxide to carbon dioxide. The regenerator 4 operates at a temperature in the range of 1000° F.–1500° F., providing the hot catalyst supplied to the standpipe 5 and completing the process cycle.

Other embodiments of the invention will be apparent to those skilled in the art from a consideration of this specification or from practice of the invention disclosed herein. It is intended that this specification be considered as exemplary only with the true scope and spirit of the invention being indicated by the following claims.

What is claimed is:

1. A process for the fluid catalytic cracking of a hydrocarbon feed, comprising the steps of:

a. contacting a hydrocarbon feed with fluidized catalytic cracking catalyst in a riser reactor and producing a suspension of hydrocarbon product and coked catalyst, said coked catalyst comprising larger coked catalyst particles and smaller coked catalyst fines;

b. grossly separating said coked catalyst particles from said suspension in an external grosscut cyclone spaced from and located externally and downstream of said reactor and producing a grossly separated first stream of hydrocarbon product and coked catalyst fines and a grossly separated second stream of coked catalyst particles;

c. substantially disengaging said coked catalyst fines from said grossly separated first stream in a disengaging vessel separate and apart from said riser reactor and said external grosscut cyclone for producing a substantially catalyst-free stream of hydrocarbon product and a stream of disengaged coked catalyst fines;

d. substantially removing volatile hydrocarbon from said coked catalyst for producing a volatile hydrocarbon product and a stripped coked catalyst by gas stripping the grossly separated second stream of coked catalyst particles and said catalyst fines stream of disengaged coked catalyst fines; and e. recycling said volatile hydrocarbon product from step (d) to the external grosscut cyclone in step (b).

2. The process of claim 1 wherein said gas stripping step comprises steam injection.

3. The process of claim 1 wherein coked catalyst is directed along a substantially convoluted path during said gas stripping step.

4. A process for the fluid catalytic cracking of a hydrocarbon feed, comprising the steps of:

a. contacting a hydrocarbon feed with regenerated fluidized catalytic cracking catalyst in a riser reactor at catalytic cracking conditions and producing a catalytically cracked product stream comprising a suspension of hydrocarbon and coked catalyst;

b. roughly separating a substantial amount of said coked catalyst from said catalytically cracked product stream in an external roughcut gross cyclone positioned in a vessel spaced from and externally of said reactor and producing a roughly separated first stream comprising hydrocarbon and a roughly separated second stream comprising coked catalyst;

c. substantially dampening the flow of said roughly separated first stream in a disengaging vessel spaced between and located externally of both said riser reactor and said vessel containing said external roughcut gross cyclone and creating a substantially steady flow of roughly separated hydrocarbon;

d. internally separating a substantial amount of the remaining catalyst from said steady flow of roughly separated hydrocarbon for producing a substantially catalyst-free upgraded product stream of hydrocarbon leaving coked catalyst fines;

e. conveying said coked catalyst fines and said roughly separated second stream of coked catalyst to a stripping zone within said vessel containing said roughcut gross cyclone and at a location below said roughcut gross cyclone, said stripping zone being separated and apart from said disengaging vessel and said reactor;

f. substantially removing volatile hydrocarbon from said coked catalyst fines and said roughly separated second stream of coked catalyst in said stripping zone at a location externally of and between said reactor and said disengaging vessel by directing said coked catalyst along a convoluted flow path in the presence of stripping steam, leaving volatile hydrocarbon product and stripped coked catalyst;

g. recycling said volatile hydrocarbon product from step (f) to the external roughcut gross cyclone in step (b), directing said volatile product flow upwardly and in countercurrent flow relationship to said roughly separated second stream comprising coked catalyst.

5. The process of claim 4 including quenching said roughly separated first stream of hydrocarbon.

6. The process of claim 4 wherein said substantially dampening comprises passing said roughly separated first stream of hydrocarbon into a disengaging vessel for minimizing intermittent surges of said substantially steady flow of roughly separated hydrocarbon.

7. The process of claim 4 wherein said internal separating comprises passing said steady flow of roughly separated hydrocarbon through at least one internal cyclone.

8. The process of claim 4 wherein said conveying step comprises steam stripping.

9. A process for the fluid catalytic cracking of a hydrocarbon feed, comprising the steps of:

a. catalytically cracking a hydrocarbon feed comprising gas oil in the presence of regenerated fluid catalytic cracking catalyst at catalytic cracking conditions in a riser reactor and producing a catalyst-laden stream of hydrocarbon and coked catalyst comprising larger coked catalyst particulates and smaller coked catalyst fines;

b. grossly cyclone separating said coked catalyst particulates from said catalyst-laden stream in an external roughcut gross cyclone in an upper portion of a unitary vessel spaced from and located externally of said reactor and producing a grossly separated particulate lean stream of hydrocarbon and a grossly separated particulate enriched stream of coked catalyst particulates;

c. injecting a quench stream into said grossly separated particulate lean stream of hydrocarbon downstream of said unitary vessel for producing a cooler quenched stream of hydrocarbon;

d. substantially dampening the flow of said cooler quenched stream of hydrocarbon by passing said stream into a disengager positioned downstream of said unitary vessel and separately and apart from said riser reactor and said external roughcut gross cyclone, leaving a substantially steady flow of cooler quenched hydrocarbon;

e. internally cyclone separating said coked catalyst fines from said substantially steady flow of cooler quenched hydrocarbon in said disengager for producing an effluent product catalyst fine lean stream of upgraded hydrocarbon and a concentrated stream of disengaged coked catalyst fines;

f. conveying said disengaged coked catalyst fines to a stripping section in a lower portion of said unitary vessel below said roughcut gross cyclone at a location separate and apart from said riser reactor and said disengager;

g. annularly passing and dispersing said grossly separated particulate enriched stream of coked catalyst particulates outwardly and downwardly to said stripping section;

h. substantially removing volatile hydrocarbon from said disengaged coked catalyst fines and said grossly separated particulate enriched stream of coked catalyst particulates in said stripping section by directing said coked catalyst along a convoluted flow path in the presence of stripping steam, leaving volatile hydrocarbon products and stripped coked catalyst;

i. recycling and directing flow of said volatile hydrocarbon product from step (h) upwardly and in countercurrent relationship to said downwardly passing grossly separated particulate enriched stream of coked catalyst particulates to the external roughcut gross cyclone in step (b), said flow of said volatile hydrocarbon product being substantially concentric and annularly surrounded by said downward flow of said grossly separated particulate enriched stream of coked catalyst particulates;

j. contacting said stripped coked catalyst with an oxygen-containing regeneration gas stream in a regeneration zone with a regeneration gas comprising molecular oxygen in excess of that necessary for substantially complete combustion of said coke to produce a regenerated catalytic cracking catalyst.

10. The process of claim 9 wherein said cracking conditions comprise a reaction temperature of from about 850° to about 1200° F.

11. The process of claim 9 wherein said quench stream comprises at least one quench selected from the group consisting of light catalytic cycle oil, heavy catalytic cycle oil, heavy catalytic naphtha, light coker gas oil, coker still distillate, kerosene, hydrotreated distillate, virgin gas oil, heavy virgin naphtha, light virgin naphtha, hydrotreated gas oil, decanted oil, and resid, and water.

12. The process of claim 9 wherein said quench stream comprises at least one quench selected from the group consisting of light catalytic cycle oil and heavy catalytic cycle oil.

13. The process of claim 9 wherein said internally cyclone separating comprises sequentially passing said substantially steady flow of cooler quenched hydrocarbon through at least two cyclone separation stages.

14. The process of claim 9 wherein said internally cyclone separating step comprises splitting said substantially steady flow of cooler quenched hydrocarbon into at least two streams, independently cyclone separating at least two of the streams, and recombining the streams to produce said effluent product catalyst fine lean stream of hydrocarbon.

15. The process of claim 9 wherein said conveying of said disengaged coked catalyst fines comprise injecting said disengaged coked catalyst fines with steam before said disengaged coked catalyst fines are completely conveyed to said stripping section.

16. The process of claim 9 wherein said annular outwardly and downwardly passing of said grossly separated particulate enriched stream of coked catalyst particulates is directed at an angle of inclination of at least ten degrees from vertically downward.

17. The process of claim 9 including injecting steam into the bottom portion of said disengager.

* * * * *